US009265291B2

(12) United States Patent
Weber

(10) Patent No.: US 9,265,291 B2
(45) Date of Patent: Feb. 23, 2016

(54) PROTECTIVE CHAPS

(71) Applicant: ARBORWEAR LLC, Chagrin Falls, OH (US)

(72) Inventor: William H. Weber, Chagrin Falls, OH (US)

(73) Assignee: ARBORWEAR LLC, Chagrin Falls, OH (US)

( * ) Notice: Subject to any disclaimer, the term of this patent is extended or adjusted under 35 U.S.C. 154(b) by 91 days.

(21) Appl. No.: 14/184,824

(22) Filed: Feb. 20, 2014

(65) Prior Publication Data

US 2014/0230116 A1 Aug. 21, 2014

Related U.S. Application Data

(60) Provisional application No. 61/767,533, filed on Feb. 21, 2013.

(51) Int. Cl.
*A41D 13/05* (2006.01)

(52) U.S. Cl.
CPC ..... *A41D 13/0543* (2013.01); *A41D 13/0568* (2013.01)

(58) Field of Classification Search
CPC A41D 13/0543; A41D 17/00; A41D 31/0055
See application file for complete search history.

(56) References Cited

U.S. PATENT DOCUMENTS

| | | | | |
|---|---|---|---|---|
| 1,801,437 | A | 4/1931 | Lown et al. | |
| 2,717,387 | A * | 9/1955 | McMahan | A41D 13/0568 2/22 |
| 3,517,394 | A * | 6/1970 | Robinson | A41D 13/04 2/51 |
| 5,095,544 | A * | 3/1992 | Elverskog | 2/22 |
| 5,375,262 | A * | 12/1994 | Carter | 2/23 |
| 6,152,893 | A | 11/2000 | Pigg et al. | |
| 6,266,818 | B1 | 7/2001 | Howland et al. | |
| 6,338,164 | B1 | 1/2002 | Howard | |
| 6,543,055 | B2 | 4/2003 | Howland et al. | |
| 6,658,666 | B2 | 12/2003 | Schweer | |
| 6,698,026 | B2 | 3/2004 | Schweer | |
| 6,839,917 | B1 * | 1/2005 | Landwehr | A41D 13/04 2/22 |
| 6,892,395 | B2 | 5/2005 | Schweer | |
| 7,926,117 | B2 | 4/2011 | Parks et al. | |
| 8,443,937 | B2 | 5/2013 | Mordecai et al. | |
| 2003/0079277 | A1 | 5/2003 | Gillen et al. | |

(Continued)

FOREIGN PATENT DOCUMENTS

| | | |
|---|---|---|
| RU | 2 093 052 C1 | 10/1997 |
| RU | 106 503 U1 | 7/2011 |

OTHER PUBLICATIONS

Protective Chaps on Sale in the United States Prior to Dec. 12, 2013, see photographs attached as Figs. 1,2,5,6,7.

(Continued)

*Primary Examiner* — Anna Kinsaul
(74) *Attorney, Agent, or Firm* — Pearne & Gordon LLP

(57) ABSTRACT

Protective chaps, such as chainsaw protective chaps, including a right legging, a left legging, and a waist attachment element such as a belt for attaching the chaps to the waist of a wearer. Each legging has preferably 2-5 strap units, such as straps, for securing the legging around the back of a leg of the wearer. One or more of the strap units is repositionable higher or lower on its legging to provide comfort and better fit for the wearer and so that a damaged strap unit or strap can be easily replaced.

21 Claims, 2 Drawing Sheets

(56) References Cited

U.S. PATENT DOCUMENTS

| | | | | |
|---|---|---|---|---|
| 2005/0114976 | A1 | 6/2005 | Beland et al. | |
| 2006/0107435 | A1 | 5/2006 | Westcott | |
| 2009/0210990 | A1 | 8/2009 | Taylor | |
| 2011/0072545 | A1 | 3/2011 | Bennett | |
| 2011/0179553 | A1 | 7/2011 | Hazlett | |
| 2012/0272467 | A1* | 11/2012 | Forbes | 15/114 |

OTHER PUBLICATIONS

Labonville brand Chap Style #L850 (see photograph attached as Fig. 3),on sale in the United States prior to Feb. 21, 2013.
Forrester brand Chap Style #Chap2L-G (see photograph attached as Fig. 4),on sale in the United States prior to Feb. 21, 2013.

* cited by examiner

PROTECTIVE CHAPS

CROSS-REFERENCE TO RELATED APPLICATION

This application claims the benefit of U.S. Provisional Application No. 61/767,533 filed on Feb. 21, 2013, the entire contents of which is hereby incorporated herein by reference.

FIELD OF THE INVENTION

The present invention relates generally to protective chaps and more particularly to protective chaps having at least one strap or strap unit per legging which goes around the back of the leg of the wearer, wherein each strap or strap unit is repositionable higher or lower on its legging.

DESCRIPTION OF RELATED ART

Protective chaps are sturdy coverings for the legs and generally including a right legging, a left legging, and a belt. They are attached over trousers but, unlike trousers, they have no seat. They are designed to provide protection for the legs, particularly the front and sides of the leg, and are accordingly frequently made of leather or other very sturdy material.

Typically, for chaps worn by arborists, each legging is attached by wrapping and attaching two or three straps around the back of the leg of the wearer. Typically, each strap is sewn to the legging.

There are two problems with sewn-in straps. First, the vertical position of the strap on the legging is not adjustable, so that, while the strap may be correctly positioned for a short wearer, when the same chap is worn by a very tall wearer, the strap will no longer be in the correct anatomical position. Secondly, if the strap is torn off or damaged such that it can no longer be used, a new strap has to be sewn in, which is difficult, time consuming and frequently expensive.

Persons operating chainsaws, such as arborists, will frequently wear chainsaw protective chaps, that is, chaps particularly designed to protect against injury from contact with a moving chain of a chainsaw. There is a need for making the straps on protective chaps, particularly chainsaw protective chaps, vertically adjustable and easily replaceable, so that, if a strap is torn or rendered unusable, it can be easily replaced and its vertical location higher or lower on its legging easily adjusted.

SUMMARY OF THE INVENTION

Protective chaps are provided, which comprise a first or left legging, a second or right legging, and waist attachment means for attaching the chaps to the waist of a wearer, each legging having at least one strap unit for securing the legging around the back of a leg of the wearer, wherein the strap unit is repositionable higher or lower on its legging.

DETAILED DESCRIPTION OF PREFERRED EMBODIMENTS OF THE INVENTION

In the description that follows, when a preferred range, such as 5 to 25 (or 5-25) is given, this means preferably at least 5 and, separately and independently, preferably not more than 25.

As used herein and in the claims, higher or up on a legging means closer to the belt at the top of the legging; lower or down on a legging means closer to the bottom of the legging. Vertically along the legging means up and down on or along the legging.

Figure 1:
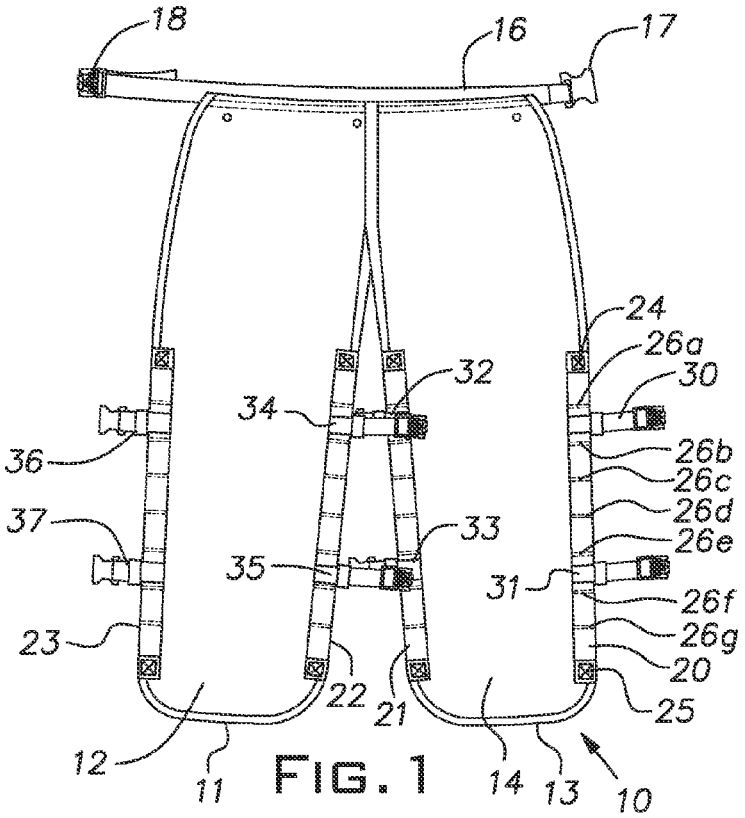
FIG. 1 is an elevational view of the back side of protective chaps according to the invention.

With reference to FIG. 1, there is shown chaps or protective chaps or chainsaw protective chaps 10 including a first or right legging 14 (having a bottom 13), a second or left legging 12 (having a bottom 11) and a waist attachment means for attaching the chaps to the waist of a wearer. The waist attachment means can be a built-in and adjustable belt 16 having a female buckle 17 and a male buckle 18 as shown; less preferably the waist attachment means can be an elastic or adjustable waistband or a plurality of belt loops for receiving a removable or separate belt. Any waist attachment means known in the art can be used. Other than with respect to the webbings and straps to be discussed later, the chaps 10 are substantially conventional and as is known in the art. For example, the leggings 12, 14 can be made of leather, heavy denim, natural fiber or synthetic fiber such as nylon, polyester, etc. The leggings 12, 14 are preferably made of 1600 denier heavy duty nylon with polyurethane coating for water resistance. The chaps 10 are preferably chainsaw protective chaps which meet the standards or requirements set forth in the ASTM F1897-2008 Standard Specifications for Leg Protection for Chainsaw Users. For example, the legging material can be 8-layer blocking material as known in the art.

Figure 2:
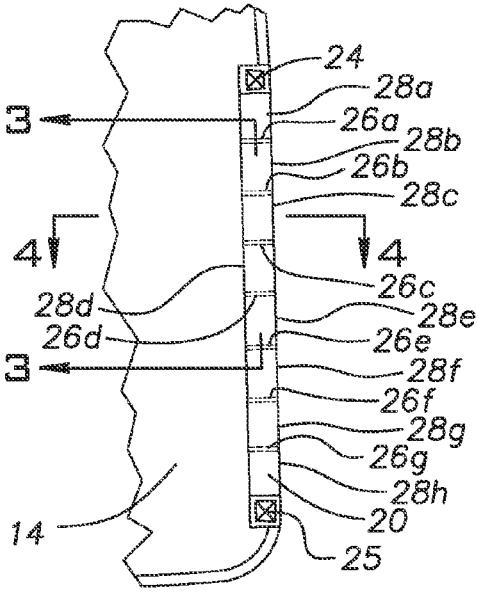
FIG. 2 is an enlarged view of the bottom-right portion of the right legging of the chaps of FIG. 1.
Figure 3:
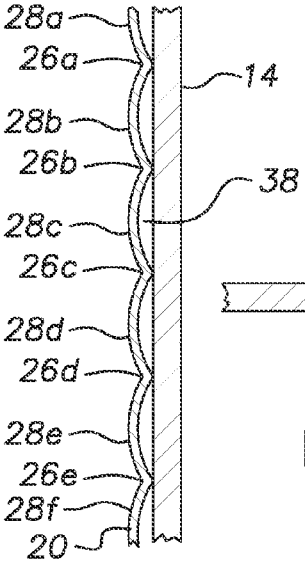
FIG. 3 is a cross-sectional view taken along line 3-3 of FIG. 2.
Figure 4:
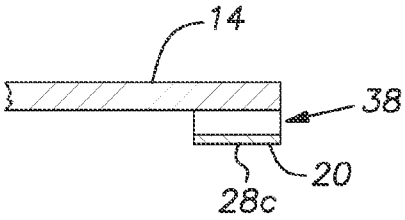
FIG. 4 is a cross-sectional view taken along line 4-4 of FIG. 2.

With reference to FIGS. 1-4, as can be seen, adjacent or at the right side or edge of legging 14 is attached a strip of webbing 20, which is preferably attached by stitching, such as X-box stitchings 24, 25 at the upper and lower ends of the webbing, respectively. Also, a bar tack or bar stitching or line of stitching 26*a*, 26*b*, 26*c*, 26*d*, 26*e*, 26*f*, 26*g* is provided periodically along webbing 20 so that a series of loops 28*a*, 28*b*, 28*c*, 28*d*, 28*e*, 28*f*, 28*g*, 28*h* in the webbing can be provided. Less preferably the webbing 20 can be attached by rivets. The lines of stitching 26*a-g* form the loops 28*a-h* in the webbing so that an opening 38 is formed between each loop 28*a-h* of the webbing 20 and the legging 14 beneath each loop 28*a-h*. Preferably, webbing 20 has 3, 4, 5, 6, 7, 8, 9, 10, 11, 12, 13, 14 or 15 loops. As shown in FIGS. 1-3, the strip of webbing 20 runs up and down the legging 14 and is fixed to the legging 14 at a series of spaced apart fixation points 26*a-g*; the portion 28*a-h* of webbing between 2 adjacent fixation points forming a loop. As shown in FIG. 1, each strip of webbing 20-21 is located at or adjacent a lateral side of legging 14. The distance between two adjacent lines of stitching 26 (ie, the width of the loop 28) is preferably at least 1, 1.5, 2, 2.5, 3, 3.5, 4, 4.5, 5, 5.5, 6, 7, 8, 9 or 10 cm; alternatively, the distance between two adjacent lines of stitching 26 (ie, the width of the loop 28) is not more than 1, 1.5, 2, 2.5, 3, 3.5, 4, 4.5, 5, 5.5, 6, 7, 8, 9 or 10 cm. The webbing 20 is preferably heavy duty nylon or other sturdy fabric or sturdy flexible material and 1 to 2 to 3 cm wide. Webbing 20 is preferably at least (or, alternatively, not more than) 10, 15, 20, 25, 30, 35, 40, 45, 50 or 60 cm long and preferably extends from near the bottom 13 of legging 14 or within 1, 2, 3, 4, 5, 6, 7 or 8 cm of the bottom 13 of legging 14 and preferably extends up legging 14 to at least above where the wearer's knee would be located and preferably to at least where the middle of the wearer's thigh would be located.

As shown in FIG. 1, the left side of legging 14 is provided with a strip of webbing 21 and legging 12 is provided with strips of webbing 23, 22. These 3 strips of webbing 21, 22, 23 are preferably the same as webbing 20.

Figure 5:
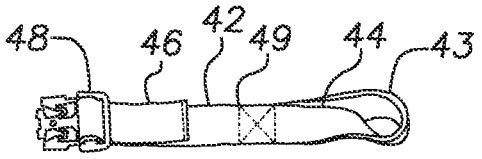
FIG. 5 shows a strap with a male buckle used in the invention.
Figure 6:
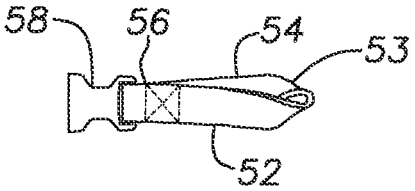
FIG. 6 shows a strap with a female buckle used in the invention.
Figure 7:
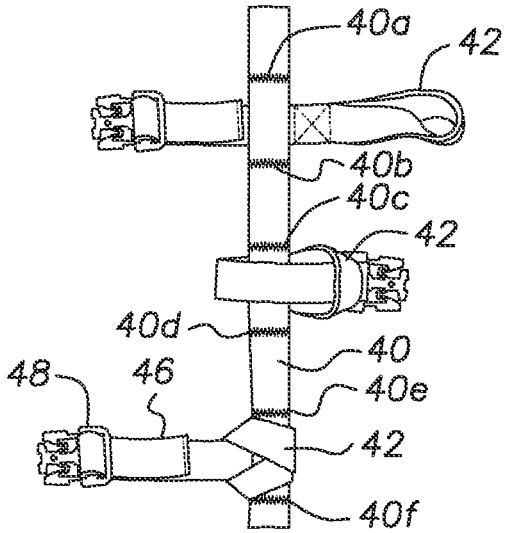
FIG. 7 shows three straps in different stages of being a ached to a strip of webbing.

With reference to FIGS. 5-7, there are shown straps 42, 52 which are removably and repositionably attached to the webbings 20-23 and are used to secure the legging around the back of the leg of the wearer. FIG. 5 shows a strap 42 made of a length of a strip 44 of fabric or webbing, preferably stretchable and elastic so that the strap 42 is elastic in its longitudinal direction; the length being folded back and X-box stitched at 49 to form a webbing attachment portion such as a loop end 43 and with a fastener element such as a male buckle 48 attached at the opposite end. The strap has a free end 46 looped through the buckle 48 as known in the art so that the strap 42 can be adjusted to make the at-rest overall length of the strap longer or shorter, ie, adjustable. Strap 42 is preferably adjustable such that, in at-rest condition, including the buckle, it can be shortened to 5, 10, 15 or 20 cm and lengthened to 30, 40, 50, 60 or 70 cm. The strap is preferably 1 to 2 to 3 cm wide.

FIG. 6 shows strap 52 constructed in substantially the same manner as strap 42 but preferably of a shorter or minimum length (such as 10 to 15 to 20 cm, including the buckle) and preferably without a free end so that it is non-adjustable and, when attached to the webbing 20, the female buckle 58 extends only a short distance away from the webbing. Strap 52 is formed from a strip 54 of fabric or webbing (the same or similar material as strap 42), having a webbing attachment portion such as a loop end 53 and a fastener element such as a female buckle 58 attached at the opposite end and preferably X-box stitched at 56. The male and female buckles are preferably those known in the art. Alternatively, other fastener elements can be used, such as male and female snaps, button and button hole, clip (or clasp) and D-ring, or hook and loop fasteners; all of these pairs can be fastened together and unfastened without damage.

FIG. 7 illustrates how each strap 42, 52, is attached to the loops 28 of the webbing, such as webbings 20-23, 40. First, as shown at the top of FIG. 7, strap 42 is slid through opening 38 between stitchings 40*a* and 40*b*. Next, as shown between stitchings 40*c* and 40*d*, the buckle end is passed through the loop end. Finally, as shown between stitchings 40*e* and 40*f*, the buckle end is grabbed and pulled to cinch up or tighten the loop end around the loop of the webbing 40. Strap 52 is attached to loops of webbing in the same way.

As shown in FIG. 1, a male strap 30 (ie, with a male buckle) and a corresponding female strap 32 (ie, with a female buckle) are attached near the top of the webbings 20, 21, respectively, and male strap 31 and corresponding female strap 33 have been attached lower down. To attach legging 14 to the wearer, the back side of legging 14 (shown in FIG. 1) is placed on top of the front of the trousers of the wearer's right leg and the straps 30, 32 are wrapped around the back of the wearer's leg and the buckles clipped together; then the straps 31, 33 are wrapped around the back of the wearer's leg and clipped together. In a similar way, the male and female straps 34, 36 are wrapped around the wearer's left leg and clipped, and the male and female straps 35, 37 are attached around the wearer's left leg in a similar manner. FIG. 1 shows each webbing having 8 loops or openings for strap attachment. Each webbing preferably has 3, 4, 5, 6, 7, 8, 9, 10, 11, 12, 13, 14 or 15 or more, loops or openings for strap attachment. Preferably, each webbing is provided with 2, 3, 4, 5, or 6 straps. Depending on the wearer's preference, the straps can be easily repositioned upward or downward and removably attached to different loops in their webbing. Also, if a strap becomes torn, lost, damaged, the buckle broken, etc., the strap can be easily replaced with a replacement strap.

Figure 8:
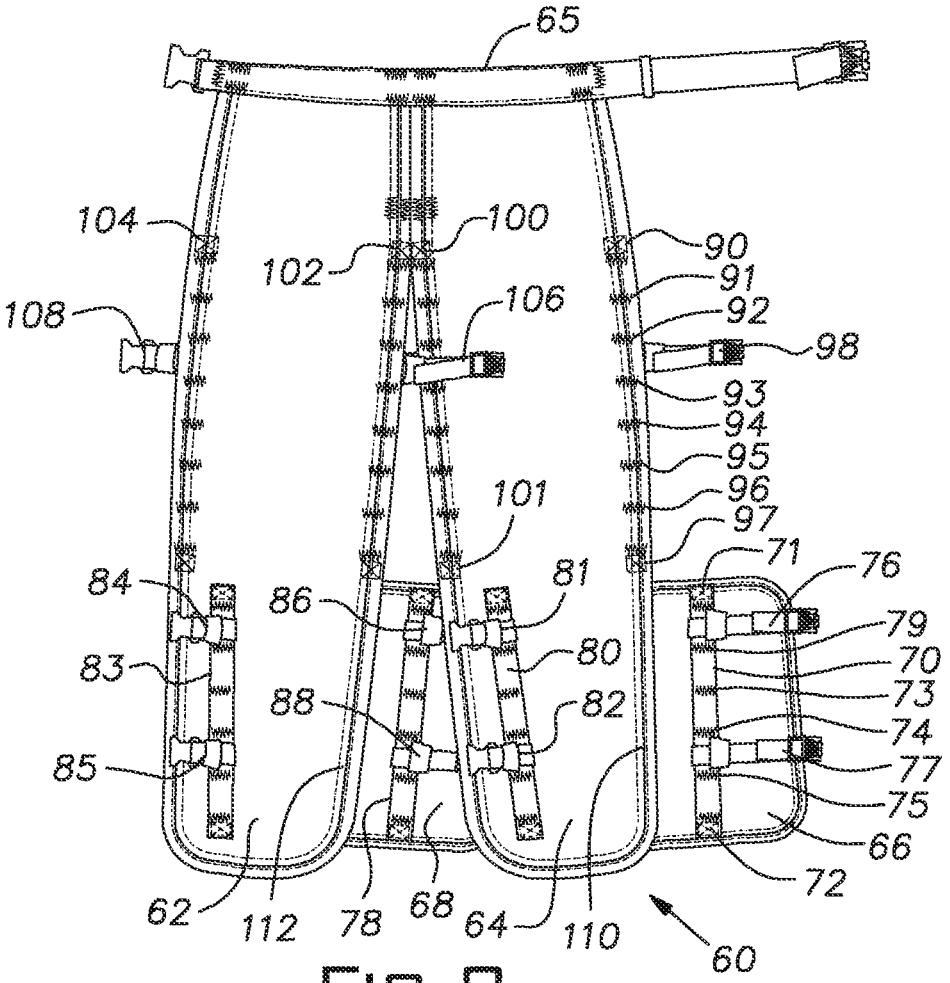
FIG. 8 is an elevational view of the front side of a second embodiment of protective chaps according to the invention.

FIG. 8 shows the front side of a second embodiment of the invention, being protective chaps or chainsaw protective chaps 60 with calf wraps. Right legging 62, left legging 64, and belt or waistband 65 are the same as in chaps 10. A flap 66 (preferably of the same material as legging 64) extends laterally from a lower portion of the legging and is attached via stitching 110, rivets, etc. to the lower portion of left legging 64; alternatively, flap 66 is unitary or monolithic or integral with legging 64. Each flap 66, 68 is preferably 7-18 cm wide and 10-30 cm high. A strip of webbing 70, oriented vertically, is attached to flap 66 as shown via X-box stitchings 71, 72 and lines of stitching 79, 73, 74, 75. Webbing 70 is the same or similar as webbing 20 and is attached in the same way. Webbing 70 preferably has 2, 3, 4, 5, 6, 7, 8, 9, 10 or more loops between lines of stitching. 1, 2, 3 or 4 straps 76, 77 with male buckles can be attached to the loops as shown. In a corresponding manner, a webbing 80, the same or similar as webbing 70, can be fixed to the front side of left legging 64, preferably at or near the left hand edge/side as shown. For example, webbing 80 can be attached at the left edge or can be moved back from the edge a short distance, for example, not more than 0.5, 1, 1.5, 2, 2.5, 3, 3.5, 4, 5, 6, 7, 8, 9 or 10 cm. For every male strap/buckle 76, 77 attached to webbing 70, a corresponding female strap/buckle 81, 82 is attached to webbing 80. In a corresponding manner, right legging 62 is provided (via stitching 112) with a flap 68 having webbing 78 and straps 86, 88, and the bottom of right legging 62 is provided with webbing 83 having straps 84 and 85. The webbing and straps for the flaps are preferably the same as the webbing and straps described above for FIG. 1. The straps on and for the flaps are repositionable and are used to secure the flap around the ankle/calf area to form a calf wrap.

As partially illustrated in the top ⅔ of FIG. 8, the back side of legging 64 is provided with webbings and straps corresponding to the webbings and straps attached to the back side of legging 12 of FIG. 1. For example, the upper right side of legging 64 shows X-box stitchings 90, 97 (attaching a webbing, not shown) which correspond to the X-box stitchings at the top and bottom of webbing 23 in FIG. 1. Lines of stitching 91-96 correspond to the lines of stitching in webbing 23 of FIG. 1. Strap 98 of FIG. 8 corresponds with strap 36 of FIG. 1. X-box stitchings 100, 101 in FIG. 8 are used to attach a webbing (not shown) to the back side of legging 64, corresponding to webbing 22 of FIG. 1. The two webbings (not shown) on the back side of the upper portion of legging 64, with their straps (preferably with as many straps as webbings 22-23), are the same as the webbings and straps 22, 23, 34-37 of FIG. 1. The back side of the upper portion of legging 62 is provided with webbings and straps the same as legging 64. The chaps 60 are attached to the wearer the same way as the chaps 10 are attached, but also with the flaps 66, 68 attached.

Less preferably, the webbings such as 20-23, 70, 80, 78, 83 can be fixed to the leggings via rivets, heat welding, adhesive, buttons, clips, or other means known in the art, located where the stitchings 26*a-h*, 79, 73, etc. are located.

Less preferably, one or more of the webbings (such as both webbings 20, 21) can be replaced with (a) a row of fasteners (such as snaps (male or female), buckles (male or female), buttons, rings for a clip, etc.) fixed to the legging and spaced apart like the stitchings 26*a-h*, or (b) a strip of Velcro-like hook and loop fastener extending up and down as long as the webbing. The ends of the straps would be modified accordingly; for example, if a webbing is replaced with a row of female snaps, the ends of the straps to be attached thereto would be provided with a male snap. If the webbing is replaced with a strip of Velcro-like loop fastener, the ends of the straps to be attached thereto would be provided with Velcro-like hook fastener.

Alternatives for Loop Ends

Alternatively, if webbing 20-23 is used, the ends of the straps can be attached thereto by means or fasteners other than the loop ends 43, 53 described above. For example, the loop end 43, 53 can be replaced with (a) a strip which is part hook fastener and part loop fastener, so it can be slid under the loop 28, folded back on itself and Velcroed in place, or (b) a strip having (1) a pair of snaps (male and female) or (2) a button and button hole or (3) a pair of buckles (male and female), spaced 6-10 cm apart, so it can be slid under the loop 28, folded back on itself and snapped or buttoned or buckled in place.

As described above, when a pair of straps 42, 52 is used between a pair of webbings such as 20, 21, male and female buckles 48, 58 are used to fasten the straps together. Less preferably, the male and female buckles can be replaced with other fastener element pairs as known in the art, such as male and female snaps, button and button hole, clip (or clasp) and D-ring, hook and loop fastener, belt buckle with prong and belt with a hole or row of holes for the buckle prong, belt end and belt buckle with sliding friction bar to grip the belt, etc.

Alternatively, one strap can be used instead of a pair of straps 42, 52. For example, if webbings 20, 21 are used, a single strap between them can be used, wherein each end of the strap is provided with a fastener as described in the paragraph above entitled "Alternatives For Loop Ends". Such a single strap can furthermore be made adjustable in length as follows. One end can be provided with a strip wherein the last 2 cm is Velcro hook fastener and the next, adjacent 30 cm is Velcro loop fastener. The strip can be slid under the loop 28, folded back on itself and Velcroed in place at different locations on the loop portion to adjust the overall length. The same effect can be achieved by putting a male snap at the end of the strip, and adjacent thereto a row of 15 female snaps spaced out one every 2 cm. The male snap portion is slid under the loop 28, folded back on the strip and snapped to one of the 15 female snaps. If one webbing 20 is used and webbing 21 is replaced with (a) a row of snaps or (b) a strip of Velcro hook and loop fastener as described above, one strap can be used as follows. Strap 42 is used, attached via loop end 43 to webbing 20 and buckle 48 is replaced with (a) a snap (to snap into the row of snaps) or (b) a hook/loop fastener strip (to Velcro attach to the strip of Velcro hook/loop fastener). If both webbings 20, 21 are replaced with a strip of Velcro loop fastener, one strap can be used by putting a strip of hook fastener at each end, one of which is extra long to make the strap overall length adjustable.

A strap unit is what attaches 2 corresponding webbings, such as webbings 20, 21 (or the alternatives thereto described above, ie, a row of snaps or a strip of Velcro hook and loop fastener), together. As shown in FIG. 1, straps 30 and 32 form a strap unit; straps 31 and 33 form a strap unit; in FIG. 8, straps 77 and 82 form a flap strap unit. Strap 30 is a portion of the strap unit formed by straps 30 and 32. A strap unit can be a single strap, such as when the strap has Velcro hook and loop fastener at each end as described above and can, by itself, attach two webbings (such as 20, 21) together.

As can be seen in the Figures, each strap unit and flap strap unit is vertically repositionable higher or lower on its legging or flap; for example, strap unit 31, 33 or strap unit 30, 32 can be repositioned upwardly or downwardly at different loops 28 along the webbings 20, 21; flap strap unit 77 and 82 can be repositioned up or down or higher or lower along the webbings 70, 80. Straps which are sewn to a legging are not removably or repositionably attached, because they are intended to be permanently attached. A strap which is sewn to a chap cannot be removed without damage or destruction, since, to remove it, the stitchings must be cut or torn, or the strap itself must be cut or torn. Straps which are attached as described above via loop ends 43, 53, via buckles, snaps, buttons/button holes, and Velcro hook and loop fasteners, are removably and repositionably attached because they can be removed and repositioned or replaced without destruction or damage. The repositionability allows a wearer to adjust the position of the strap units for comfort or better fit, and allows for adjustment when a chap is worn by a second wearer who has longer or shorter legs than a first wearer.

As shown in FIG. 8, each strip of webbing 70, 80, 78, 83 extends up and down its respective legging or flap, and webbing 80 is located across from webbing 70.

A sawyer or arborist or worker can use the protective chaps by putting on the protective chaps, grabbing ahold of a chainsaw, and using the chainsaw to cut a limb or trunk of the tree.

While the invention has been described with reference to the preferred embodiments, it is understood that various changes can be made and equivalents may be substituted for elements thereof without departing from the scope of the invention.

What is claimed is:

1. Protective chaps comprising a first legging, a second legging, and waist attachment means for attaching the chaps to a waist of a wearer; each legging having at least one strap unit for securing the respective legging around the back of a leg of the wearer, wherein each strap unit is repositionable higher or lower on its legging, wherein each legging includes at least 3 loops, the first loop being located higher on its legging than the second loop, the second loop being located higher on its legging than the third loop, at least a portion of said strap unit of said first legging being (a) distinct from and (b) removably attached to, one of said 3 loops of said first legging, at least a portion of said strap unit of said second legging being removably attached to one of said 3 loops of said second legging, wherein when said at least a portion of said strap unit of said first legging is removed from said one of said 3 loops of said first legging, said one of said 3 loops of said first legging remains attached to said first legging, wherein each legging is provided with a first strip of webbing extending vertically along the legging and being fixed to the legging at a series of spaced apart fixation points, wherein, with respect to each legging, each of said 3 loops of said legging being formed by a respective portion of said first strip of webbing between 2 adjacent fixation points.

2. The protective chaps according to claim 1, wherein each legging is provided with a second strip of webbing extending vertically along the legging and being fixed to the legging at a series of spaced apart fixation points, each respective portion of said second strip of webbing between 2 adjacent fixation points forming a loop, wherein, with respect to each legging, the first strip of webbing is located at or adjacent a first lateral side of the legging and the second strip of webbing is located at or adjacent a second, opposite, lateral side of the legging.

3. The protective chaps according to claim 1, wherein each legging includes 3-15 loops located vertically along the legging.

4. The protective chaps according to claim 1, each loop having a width, the width of each loop being 1 to 10 cm.

5. The protective chaps according to claim 1, each loop having a width, the width of each loop being 2 to 6 cm.

6. The protective chaps according to claim 1, wherein each legging has at least 2 strap units, with respect to each legging, each of the strap units includes a first strap having a webbing attachment portion at a first end and a fastener element at or adjacent an opposite end, each said first strap being removably attached to a different loop of the first strip of webbing.

7. The protective chaps according to claim 2, wherein each legging has at least 2 strap units, with respect to each legging, each of the strap units includes a first strap and a second strap, each of the first and second straps having a webbing attachment portion at a first end and a fastener element at or adjacent an opposite end, each said first strap webbing attachment portion being removably attached to a different loop of the first strip of webbing, each said second strap webbing attachment portion being removably attached to a different loop of the second strip of webbing.

8. The protective chaps according to claim 6, wherein each first strap has an at-rest overall length which is adjustable.

9. The protective chaps according to claim 6, wherein each first strap is elastic in its longitudinal direction.

10. The protective chaps according to claim 7, wherein, with respect to each strap unit, the first strap fastener element and the second strap fastener element can be fastened together and unfastened without damage.

11. The protective chaps according to claim 10, wherein the first strap fastener element is a male buckle and the second strap fastener element is a female buckle.

12. The protective chaps according to claim 1, the first legging comprising a first flap extending laterally from a lower portion thereof, the second legging comprising a second flap extending laterally from a lower portion thereof, the lower portion of each legging having at least one flap strap unit for securing its respective flap around a lower portion of the wearer's leg.

13. The protective chaps according to claim 12, wherein each flap strap unit is repositionable higher or lower on its legging.

14. The protective chaps according to claim 13, wherein each flap is provided with a third strip of webbing extending vertically along the flap and being fixed to the flap at a series of spaced apart fixation points, each respective portion of said third strip of webbing between 2 adjacent fixation points forming a loop.

15. The protective chaps according to claim 14, wherein each legging is provided with a fourth strip of webbing extending vertically along the legging and being fixed to the legging at a series of spaced apart fixation points, each respective portion of said fourth strip of webbing between 2 adjacent fixation points forming a loop, wherein, with respect to each legging, the fourth strip of webbing is located across from the third strip of webbing.

16. The protective chaps according to claim 15, wherein, with respect to each legging, the flap strap unit includes a first strap and a second strap, each of the first and second straps having a webbing attachment portion at a first end and a fastener element at or adjacent an opposite end, each said first strap webbing attachment portion being removably attached to a different loop of the third strip of webbing, each said second strap webbing attachment portion being removably attached to a different loop of the fourth strip of webbing.

17. The protective chaps according to claim 16, wherein, with respect to each flap strap unit, the first strap fastener element and the second strap fastener element can be fastened together and unfastened without damage.

18. The protective chaps according to claim 17, wherein the first strap fastener element is a male buckle and the second strap fastener element is a female buckle.

19. The protective chaps according to claim 1, wherein the protective chaps are chainsaw protective chaps meeting the requirements of ASTM F1897-2008.

20. A method of cutting a tree, comprising the following steps:

(a) putting on a pair of protective chaps;

(b) grabbing ahold of a chainsaw; and (c) using the chainsaw to cut a limb or trunk of the tree;

wherein said protective chaps comprise a first legging, a second legging, and waist attachment means for attaching the chaps to a waist of a wearer; each legging having at least one strap unit for securing the respective legging around the back of a leg of the wearer, wherein each strap unit is repositionable higher or lower on its legging, wherein each legging includes at least 3 loops, the first loop being located higher on its legging than the second loop, the second loop being located higher on its legging than the third loop, at least a portion of said strap unit of said first legging being (a) distinct from and (b) removably attached to, one of said 3 loops of said first legging, at least a portion of said strap unit of said second legging being removably attached to one of said 3 loops of said second legging, wherein when said at least a portion of said strap unit of said first legging is removed from said one of said 3 loops of said first legging, said one of said 3 loops of said first legging remains attached to said first legging, wherein each legging is provided with a first strip of webbing extending vertically along the legging and being fixed to the legging at a series of spaced apart fixation points, wherein, with respect to each legging, each of said 3 loops of said legging being formed by a respective portion of said first strip of webbing between 2 adjacent fixation points.

21. Protective chaps comprising a first legging, a second legging, and waist attachment means for attaching the chaps to a waist of a wearer; each legging having at least one strap unit for securing the respective legging around the back of a leg of the wearer, wherein each strap unit can be removed from its legging without damage or destruction, wherein each legging includes at least 3 loops, the first loop being located higher on its legging than the second loop, the second loop being located higher on its legging than the third loop, at least a portion of said strap unit of said first legging being (a) distinct from and (b) removably attached to, one of said 3 loops of said first legging, at least a portion of said strap unit of said second legging being removably attached to one of said 3 loops of said second legging, wherein when said at least a portion of said strap unit of said first legging is removed from said one of said 3 loops of said first legging, said one of said 3 loops of said first legging remains attached to said first legging, wherein each legging is provided with a first strip of webbing extending vertically along the legging and being fixed to the legging at a series of spaced apart fixation points, wherein, with respect to each legging, each of said 3 loops of said legging being formed by a respective portion of said first strip of webbing between 2 adjacent fixation points.

* * * * *